US005303754A

United States Patent [19]

Rautio

[11] Patent Number: 5,303,754

[45] Date of Patent: Apr. 19, 1994

[54] FASTENING SYSTEM FOR A RIP-SAW BLADE AND A CHIPPING EDGER

[76] Inventor: Kauko Rautio, SF-52700 Mäntyharju, Mäntyharju, Finland, SF-52700

[21] Appl. No.: 973,446

[22] Filed: Nov. 9, 1992

[30] Foreign Application Priority Data

Nov. 18, 1991 [FI] Finland ..... 915440

[51] Int. Cl.[5] ..... B27G 13/00

[52] U.S. Cl. ..... 144/237; 144/39; 144/231; 144/41

[58] Field of Search ..... 144/39, 41, 218, 231, 144/236, 237

[56] References Cited

U.S. PATENT DOCUMENTS

| | | | |
|---|---|---|---|
| 1,014,794 | 1/1912 | Wrinbach | 144/231 |
| 1,842,964 | 1/1932 | Fetner | 144/231 |
| 1,883,392 | 10/1932 | Moll . | |
| 2,635,657 | 4/1953 | Dietrich | 144/41 |
| 2,788,812 | 4/1957 | Jacobs . | |
| 2,818,094 | 12/1957 | Bowling | 144/236 |
| 3,212,724 | 10/1965 | Henderson . | |
| 4,279,280 | 7/1981 | Pairis | 144/1 F |
| 4,300,604 | 11/1981 | Zimmerman | 144/41 |
| 4,505,086 | 3/1985 | Hansen | 144/231 |
| 4,561,477 | 12/1985 | Zimmerman | 144/39 |

FOREIGN PATENT DOCUMENTS

| | | |
|---|---|---|
| 1260808 | 9/1989 | Canada . |
| 3508716C1 | 2/1986 | Fed. Rep. of Germany . |
| 3508716 | 2/1986 | Fed. Rep. of Germany . |
| 88009335 | 5/1988 | Fed. Rep. of Germany . |
| 304101 | 9/1968 | Sweden . |

*Primary Examiner*—W. Donald Bray
*Attorney, Agent, or Firm*—Pennie & Edmonds

[57] ABSTRACT

A fastening system for a rip saw blade and chipping edger combination includes at least one rip saw blade provided with holes and at least one chipping edger mounted collinearly and adjacent to the rip saw blade on a turning arbor so that the teeth of the chipping edger is aligned with the holes provided in the rip saw blade. The rip saw blade, the chipping edge and the turning arbor are all held stationary relative to each other by anchoring the same on the turning arbor with a fastening device such as a nut. An intermediate space or recess is provided between the rip saw blade and the chipping edger to permit the rip saw blade to yield in either lateral direction.

15 Claims, 2 Drawing Sheets

FASTENING SYSTEM FOR A RIP-SAW BLADE AND A CHIPPING EDGER

BACKGROUND

The object of the present invention is a fastening system for a rip-saw blade and a chipping edger, the system including one rip-saw blade or a plurality of rip-saw blades, as well as chipping edgers fastened in connection with the rip-saw blade or blades, and spacing sleeves between the rip-saw blades. Fastening systems of this type are used in saw-benches, such as hewing saws and resaws. For example, DE Patent 35 08 716 discloses one prior-art fastening system of this type for a rip-saw blade and a chipping edger.

In prior art, a rip-saw blade has been secured to a chipping edger by means of, for example, screws as close as possible to the cutting teeth of the chipping edger in such a way that wood material would not be wedged between the rip-saw blade and the chipping edger. Even though a hole has been made in the rip-saw blade in the area of the tooth of the chipping edger, there has, nevertheless, been the problem of wood material wedging between the chipping edger and the rip-saw blade. This results in the rip-saw blade bending. When the load is in the opposite direction, the rip-saw blade will yield in other parts except in the area of the attachment of the chipping edger, at which it will rub against the wood, heat up, bend, and burn the surface of the wood.

SUMMARY OF THE INVENTION

The object of the invention is to eliminate the disadvantages described above. The fastening system according to the invention for a rip-saw blade and a chipping edger is characterized in that all the tools, the rip-saw blades and chipping edgers, as well as the tightening sleeves and spacing sleeves, are tightened against each other on the turning arbor by means of a tightening member such as a nut.

One preferred embodiment of the invention is characterized in that the pressing of the rip-saw blades and the chipping edgers against each other takes place in the axial direction by mediation of sleeves.

Another embodiment of the invention is characterized in that the rip-saw blade has a hole, known per se, for the tooth of the chipping edger, and that on the inside of the chipping edger in the radial direction of the chipping edge tooth, between the chipping edger and the rip-saw blade, there is an intermediate space in the chipping edger so that the rip-saw blade can freely yield in either lateral direction.

A third embodiment of the invention is characterized in that the outer diameters of the tightening sleeves and the spacing sleeves are the same.

With the help of the invention, the rip-saw blade may thus freely move in the lateral directions under lateral forces. Any wood material ending up between the rip-saw blade and the chipping edger now has free access into the space in between, from where it will come out with equal ease. As the rip-saw blade can thus yield freely, it will not heat up or bend, and thus will not burn the wood surface at the machining stage. The work steps relating to screws, holes and threads, and any associated work steps, are eliminated. The replacement of tools and maintenance steps are also more rapid, since all the tools can be detached from each other by means of one and the same nut.

DESCRIPTION OF THE DRAWINGS

The invention is described below with the help of an example, with reference to the accompanying drawings, in which.

DETAILED DESCRIPTION OF THE INVENTION

Figure 1:
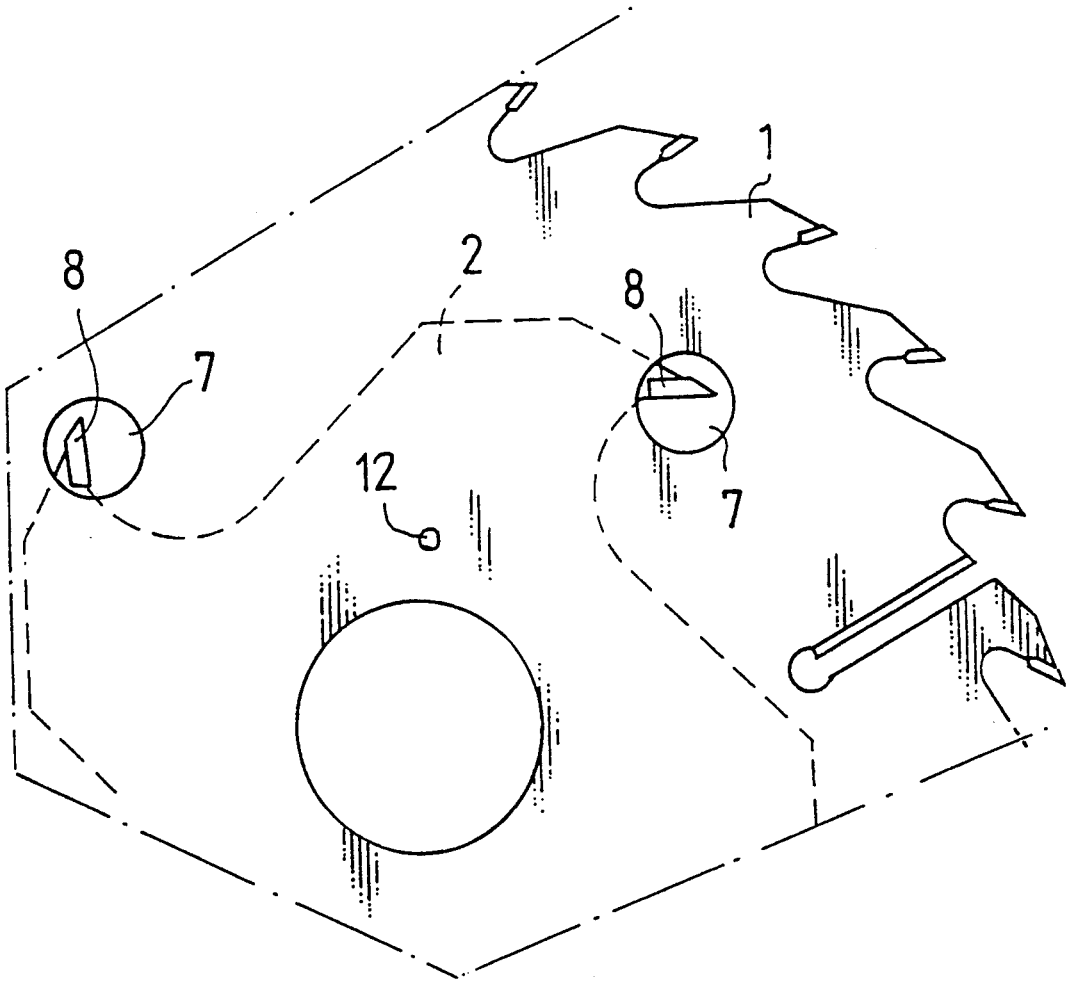
FIG. 1 depicts a rip-saw blade and a chipping edger as seen in the direction of the arbor.
Figure 2:
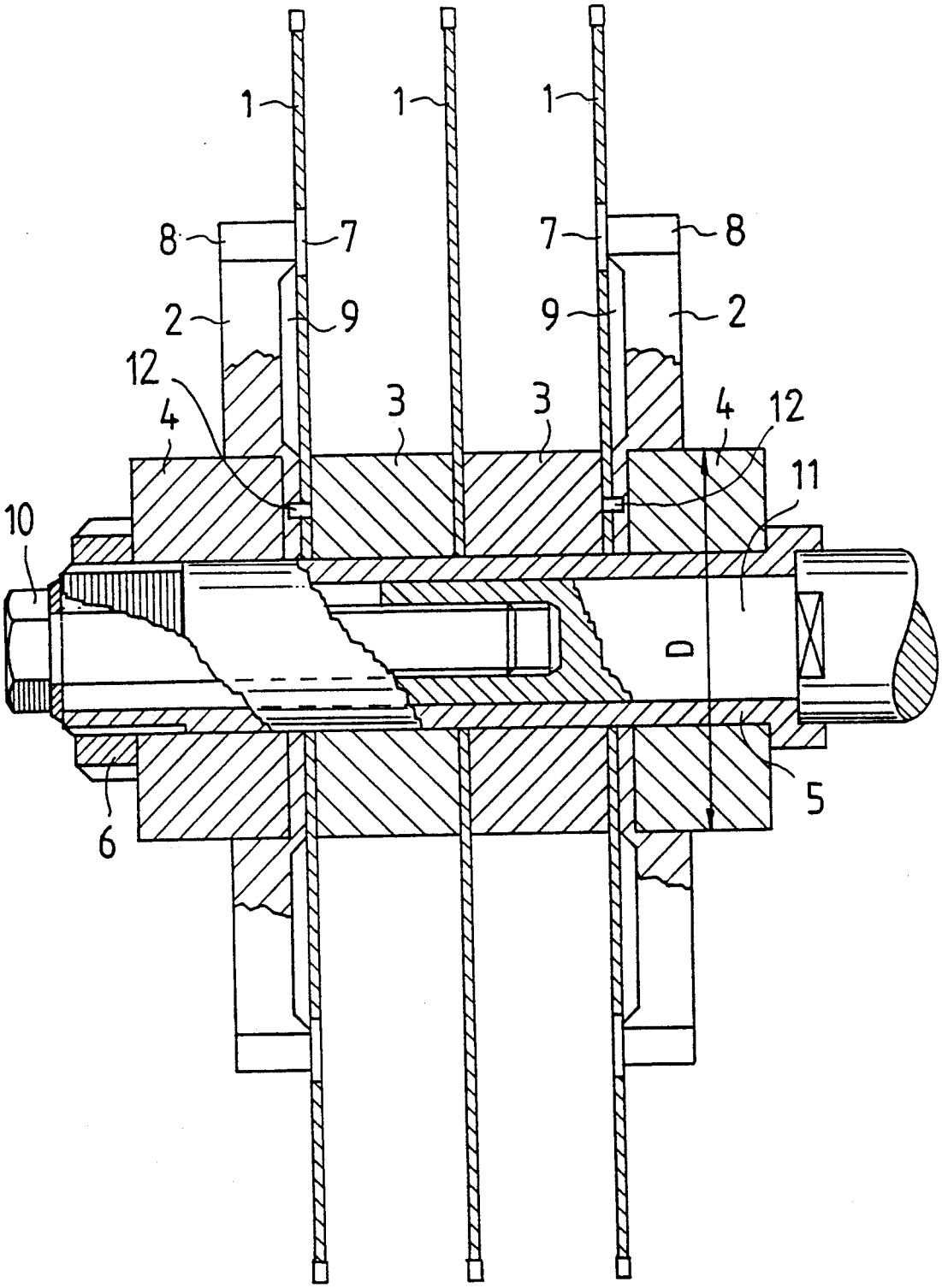
FIG. 2 depicts a cross sectional view of the rip-saw blade and the chipping edger.

The fastening system for a rip-saw blade 1 and a chipping edger 2 includes three rip-saw blades, as well as chipping edgers fastened in connection with the outermost rip-saw blades. Between the rip-saw blades 1 there are spacing sleeves 3. All the tools, rip-saw blades 1 and chipping edgers 2, as well as the tightening sleeves 4 and spacing sleeves 3, are tightened against each other on the turning arbor 5 by means of a nut 6. The rip-saw blade 1 has a hole 7 for the tooth 8 of the chipping edger 2. Inside the chipping edger 1 in the radial direction of the tooth 8, between the chipping edger and the rip-saw blade 1, there is an intermediate space 9 in the chipping edger 2 so that the rip-saw blade can freely yield in either lateral direction. The inner edge of the intermediate space 9, as seen in the radial direction, extends to the same point as does the outer diameter D of the tightening sleeves and spacing sleeves 3, 4. Between the rip-saw blade 1 and the chipping edger 2 there is a guide stud 12, which keeps the parts synchronized in relation to each other so that the tooth will remain in the area of the hole 7. The entire tool assembly is tightened by means of a bolt 10 to the turning arbor 11, which is in a manner known per se connected to a power source, i.e. an electric motor.

I claim;

1. In a fastening system having at least one rip-saw blade mounted adjacent at least one chipping edger on a turning arbor, the improvement comprising:

a plurality of rip-saw blades collinearly mounted on said arbor;

spacing sleeves provided between adjacent blades to space said blades along an axial direction of said arbor;

at least one chipping edger each mounted adjacent one of said blades on said arbor, said edger having at least one cutting edge and a recess formed on one side thereof between said arbor and said cutting edge, wherein said edger is mounted on said arbor with said one side formed with said recess facing one side of said blade such that said recess permits said blade to yield laterally thereinto;

a tightening sleeve mounted adjacent each edger, wherein the outer radial dimensions of said tightening and spacing sleeves are substantially the same and wherein said recess extends substantially from said cutting edge of said edger to the outer dimension of said tightening and spacing sleeves; and means for holding said blade and edger from moving relative to each other on said arbor.

2. A fastening system according to claim 1, wherein at least one of said blades has a hole formed between the periphery thereof and said arbor, and wherein at least one of said at least one cutting edge of said edger is aligned with said hole.

3. In a fastening system having at least one rip-saw blade mounted adjacent at least one chipping edger on a turning arbor, the improvement comprising:

a rip-saw blade mounted on said arbor, said blade having cutting edges formed on the periphery thereof and provided with at least one hole formed between said cutting edges and said arbor;

a chipping edger mounted on said arbor, said edger having at least one cutting edge and a recess formed on one side of said edger between said arbor and said cutting edge, wherein said edger is mounted on said arbor with said one side formed with said recess facing one side of said blade such that said recess permits said blade to yield laterally thereinto and with at least one of said at least one cutting edge aligned with said hole; and means for holding said blade and edger from moving relative to each other on said arbor.

4. A fastening system according to claim 3, wherein a plurality of rip-saw blades are mounted on said arbor and further comprising a plurality of spacing sleeves mounted between said adjacent blades to space said blades along an axial direction of said arbor, and wherein a plurality of chipping edgers each mounted adjacent one of said blades.

5. A fastening system according to claim 4, wherein each of said edgers is provided with said recess and each of the corresponding number of said blades is provided with said at least one hole.

6. A fastening system according to claim 5, further comprising a tightening sleeve mounted adjacent each edger.

7. A fastening system according to claim 6, wherein said holding means comprises a nut threadedly mounted on said arbor to press all of said blades and said edgers against each other in said axial direction along said arbor.

8. A fastening system according to claim 6 or 7, wherein the outer radial dimensions of said tightening and spacing sleeves are substantially the same and wherein said recess extends substantially from said cutting edge of said edger to the outer dimension of said tightening and spacing sleeves.

9. A rip-saw blade and chipping edger mounting system comprising:

a turning arbor;

a rip-saw blade coaxially mounted on said arbor, said blade having cutting edges formed on the periphery thereof and at least one hole formed between said cutting edges and said arbor;

a chipping edger mounted on said arbor, said edger having at least one cutting edge and a recess formed on one side of said edger between said arbor and said cutting edge, wherein said edger is mounted on said arbor with said one side formed with said recess facing one side of said blade such that said recess permits said blade to yield laterally thereinto and with at least one of said at least one cutting edge aligned with said hole; and means for holding said blade and edger from moving relative to each other on said arbor.

10. A fastening system according to claim 9, further comprising a plurality of rip-saw blades coaxially mounted on said arbor, spacing sleeves provided between said adjacent blades to space said blades along an axial direction of said arbor, and a plurality of chipping edgers each mounted adjacent one of said blades.

11. A fastening system according to claim 10, wherein each of said edgers is provided with said recess and each of the corresponding number of said blades is provided with said at least one hole.

12. A fastening system according to claim 11, further comprising a tightening sleeve mounted adjacent each edger.

13. A fastening system according to claim 12, wherein said holding means comprises a nut threadedly mounted on said arbor to press all of said blades and said edgers against each other in said axial direction along said arbor.

14. A fastening system according to claim 12 or 13, wherein the outer radial dimensions of said tightening and spacing sleeves are substantially the same and wherein said recess extends substantially from said cutting edge of said edger to the outer dimension of said tightening and spacing sleeves.

15. A fastening system according to claim 11, wherein three of rip-saw blades are mounted to said arbor, with outer two blades having said hole and said edger is provide adjacent each of said outer blades, wherein said one sides of said outer blades face in the opposition direction away from each other.

* * * * *